US009999963B2

(12) United States Patent
Takeda et al.

(10) Patent No.: US 9,999,963 B2
(45) Date of Patent: Jun. 19, 2018

(54) CLAMP APPARATUS

(71) Applicant: SMC CORPORATION, Chiyoda-ku (JP)

(72) Inventors: Kenichi Takeda, Noda (JP); Chiaki Fukui, Abiko (JP); Takeshi Seo, Nagareyama (JP)

(73) Assignee: SMC CORPORATION, Chiyoda-ku (JP)

( * ) Notice: Subject to any disclaimer, the term of this patent is extended or adjusted under 35 U.S.C. 154(b) by 7 days.

(21) Appl. No.: 15/122,684

(22) PCT Filed: Feb. 12, 2015

(86) PCT No.: PCT/JP2015/054506
§ 371 (c)(1),
(2) Date: Aug. 31, 2016

(87) PCT Pub. No.: WO2015/151623
PCT Pub. Date: Oct. 8, 2015

(65) Prior Publication Data

US 2017/0072540 A1 Mar. 16, 2017

(30) Foreign Application Priority Data

Apr. 1, 2014 (JP) ..... 2014-075262

(51) Int. Cl.
*B25B 5/12* (2006.01)
*B25B 5/06* (2006.01)
*B25B 5/16* (2006.01)

(52) U.S. Cl.
CPC ..... *B25B 5/122* (2013.01); *B25B 5/064* (2013.01); *B25B 5/16* (2013.01); *B25B 5/163* (2013.01)

(58) Field of Classification Search
CPC .. B25B 5/12; B25B 5/122; B25B 5/00; B25B 5/18; B25B 5/16
(Continued)

(56) References Cited

U.S. PATENT DOCUMENTS 4,905,973 A * 3/1990 Blatt ..... B25B 5/163 269/228
5,996,984 A * 12/1999 Takahashi ..... B25B 5/16 269/228
(Continued)

FOREIGN PATENT DOCUMENTS

DE 10 2004 056 229 A1 5/2006
EP 0 747 172 A1 12/1996
(Continued)

OTHER PUBLICATIONS

International Search Report dated May 12, 2015 in PCT/JP2015/054506 filed Feb. 12, 2015.
(Continued)

*Primary Examiner* — Christopher M Koehler
*Assistant Examiner* — Tyrone V Hall, Jr.
(74) *Attorney, Agent, or Firm* — Oblon, McClelland, Maier & Neustadt, L.L.P.

(57) ABSTRACT

A clamp apparatus includes a support body that projects in a sideways direction of a body, together with a clamp arm, which is disposed rotatably in facing relation to the support body. On the support body, a support member, which extends in a horizontal direction, is disposed detachably with respect to a coupling hole of the body, whereas a connecting body, which interconnects a pair of arm members, is disposed detachably on an end of the clamp arm. A clamp release mechanism, which releases a clamped state when the clamp arm is locked, is disposed in the body, and is configured to press a joint of a driving force transmission
(Continued)

mechanism that is accommodated in the body toward the side of a drive unit.

5 Claims, 11 Drawing Sheets

(58) Field of Classification Search
USPC ..... 269/32
See application file for complete search history.

(56) References Cited

U.S. PATENT DOCUMENTS

| | | | | |
|---|---|---|---|---|
| 6,115,898 | A | 9/2000 | Sawdon | |
| 6,199,847 | B1 | 3/2001 | Fukui | |
| 6,378,856 | B1 | 4/2002 | Takahashi | |
| 6,997,447 | B2 * | 2/2006 | Fukui | B25B 5/16 269/32 |
| 8,132,800 | B2 * | 3/2012 | Tamai | B25B 5/122 269/228 |
| 8,136,803 | B2 * | 3/2012 | McIntosh | B25B 5/122 269/140 |
| 2001/0003388 | A1 | 6/2001 | Takahashi et al. | |
| 2015/0145195 | A1 * | 5/2015 | Fukui | B25B 5/16 269/32 |
| 2016/0354902 | A1 * | 12/2016 | Fukui | B25B 5/064 |

FOREIGN PATENT DOCUMENTS

| | | | |
|---|---|---|---|
| EP | 0 862 970 | A2 | 9/1998 |
| EP | 0 995 540 | A2 | 4/2000 |
| EP | 2 174 752 | A1 | 4/2010 |
| JP | 2001-162473 | | 6/2001 |
| TW | 476690 | | 2/2002 |
| WO | 2014/010390 | A1 | 1/2014 |

OTHER PUBLICATIONS

Written Opinion of the International Searching Authority dated May 12, 2015 in PCT/JP2015/054506 filed Feb. 12, 2015.
Office Action dated Nov. 8, 2016 in Japanese Patent Application No. 2014-075262 w/English translation.
Office Action dated Jan. 11, 2017 in Taiwanese Patent Application No. 104106458 (with English translation).

* cited by examiner

CLAMP APPARATUS

TECHNICAL FIELD

The present invention relates to a clamp apparatus driven under the supply of a pressure fluid, which is used for clamping a workpiece on an automated assembly line or the like.

BACKGROUND ART

Heretofore, for example, in an automated assembly line for automobiles, an assembly process has been carried out in which clamping is performed by a clamp apparatus under a condition in which preformed body panels are positioned in an overlaid manner and the body panels are welded together.

Such a clamp apparatus, for example, as disclosed in U.S. Pat. No. 4,905,973, is equipped with a body, a drive unit which includes a cylinder connected to the body, and a clamp arm that projects externally with respect to the body. In addition, by displacing a piston of the drive unit upon supply of air to the cylinder, a piston rod is displaced together with the piston, whereby the clamp arm, which is connected to a link mechanism constituted from a plurality of arms, is rotated through a predetermined angle. Consequently, a workpiece or the like can be clamped by the clamp arm.

SUMMARY OF INVENTION

With the aforementioned clamp apparatus, for example, cases occur in which output from the drive unit is stopped due to various causes, and the workpiece becomes locked in a state of being clamped by the clamp arm. As a result, although in the clamped state, the workpiece cannot be removed, in certain situations, there may be a requirement to remove the workpiece by releasing the clamped state of the workpiece.

Further, for example, in the case that workpieces of different shapes are to be clamped, it is necessary to prepare a plurality of different clamp apparatus having clamp arms of different lengths, leading to a rise in equipment costs.

A general object of the present invention is to provide a clamp apparatus which, even in the case that an output is not obtained from a drive unit, a clamped state of the workpiece can easily be released, together with enabling workpieces of various shapes to be handled and clamped appropriately.

A clamp apparatus for clamping a workpiece by rotation of a clamp arm includes:

a body;

a drive unit including a piston that is displaced along an axial direction upon supply of a pressure fluid;

a driving force transmission mechanism disposed in an interior of the body and including a joint to which the drive unit is connected, the driving force transmission mechanism converting linear displacement of the drive unit along the axial direction into rotational displacement, and transmitting a driving force of the drive unit to the clamp arm;

a support body disposed detachably with respect to the body, the workpiece being gripped between the clamp arm and the support body; and a clamp release mechanism, which is configured to release a clamped state by the clamp arm at a time that the workpiece is clamped.

The clamp arm includes a pair of arm members supported rotatably with respect to the body, and a connecting body, which interconnects end portions of the arm members, the connecting body being disposed detachably with respect to the arm members.

According to the present invention, in the clamp apparatus, which is configured to grip a workpiece upon rotation of the clamp arm, the driving force transmission mechanism is provided, which transmits to the clamp arm a driving force of the drive unit in the interior of the body, and the support body is disposed detachably on the body for gripping the workpiece between the clamp arm and the support body. Further, by the clamp release mechanism, a clamped state of the workpiece at the time that the workpiece is clamped can be released.

Accordingly, by providing the support body detachably with respect to the body, and further providing the connecting body detachably with respect to the clamp arm, the support body and the connecting body can be exchanged appropriately to match with the size or shape of the workpiece. Thus, with a single clamp apparatus, workpieces of various sizes can be handled and clamped appropriately. Therefore, compared to the case of preparing different clamp apparatus respectively corresponding to different workpieces, investments in equipment can be suppressed.

Further, in the body, in a clamped state of the workpiece by the clamp arm, even if due to some reason the driving force from the drive unit is stopped, by a non-illustrated worker operating the clamp release mechanism, the clamped state can forcibly be released manually. Therefore, the clamped state of the workpiece can be released, and the workpiece can be removed.

The above and other objects, features, and advantages of the present invention will become more apparent from the following description when taken in conjunction with the accompanying drawings in which preferred embodiments of the present invention are shown by way of illustrative example.

DESCRIPTION OF EMBODIMENTS

Figure 1:
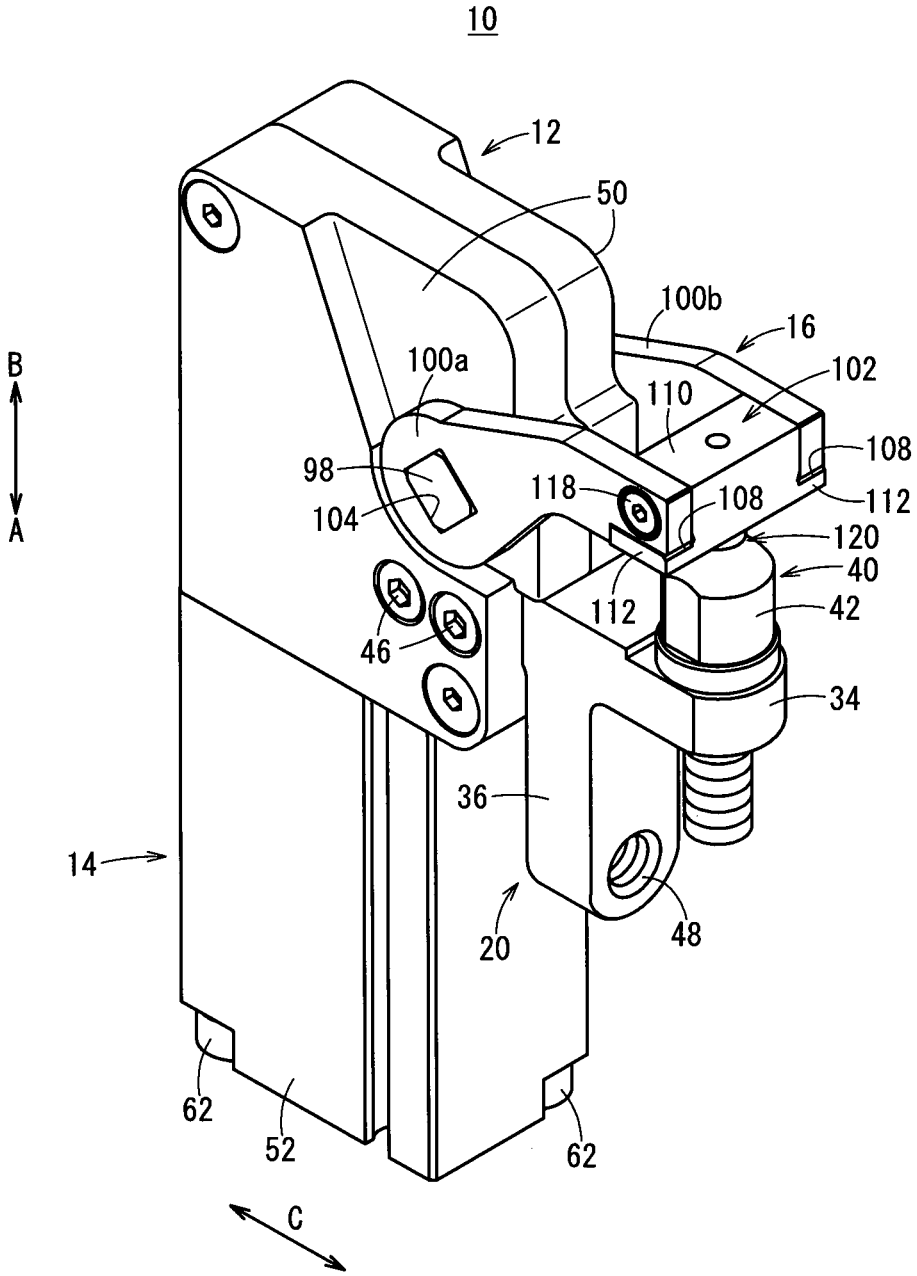
FIG. 1 is an exterior perspective view of a clamp apparatus according to an embodiment of the present invention.
Figure 2:
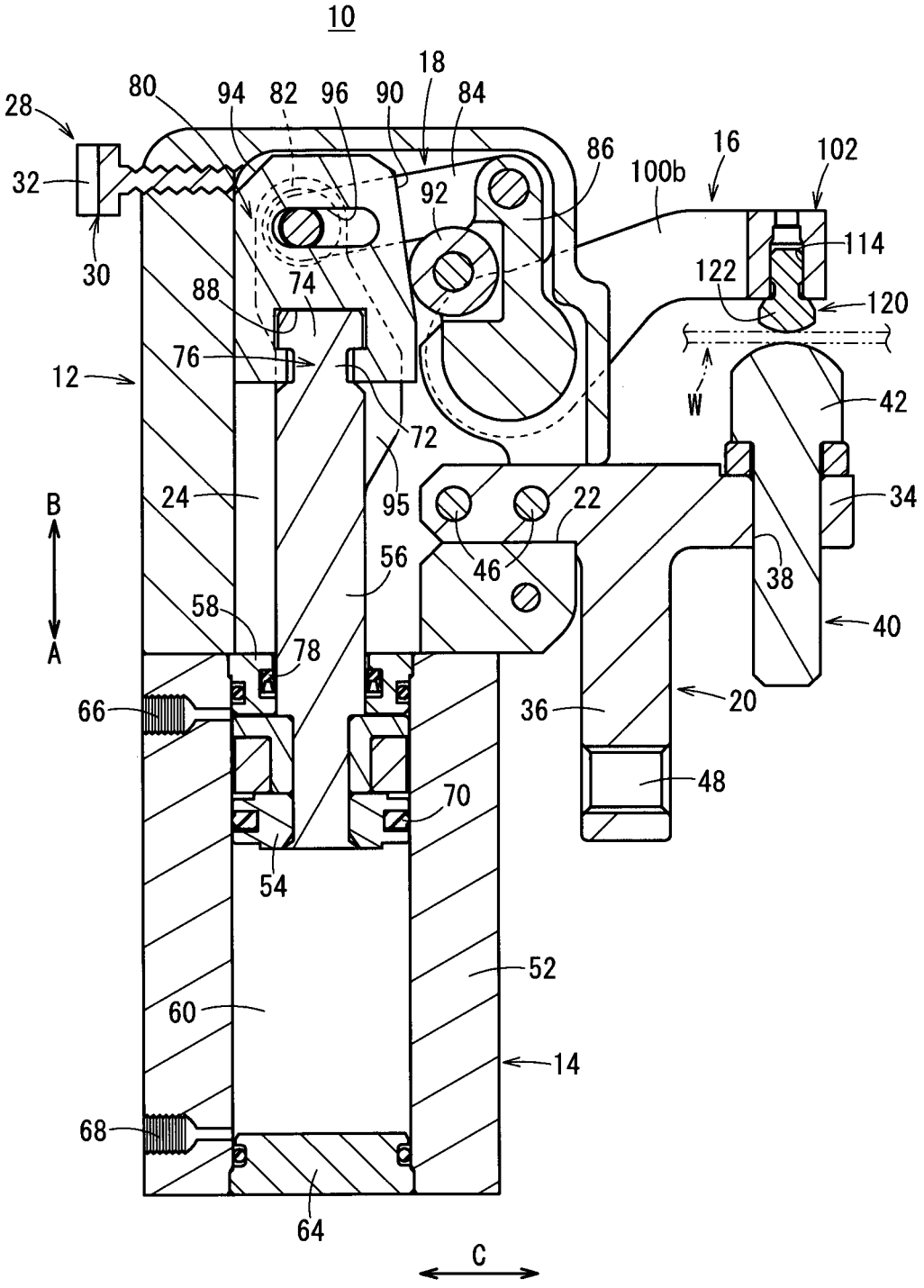
FIG. 2 is an overall cross-sectional view showing a clamped state of the clamp apparatus of FIG. 1.
Figure 3:
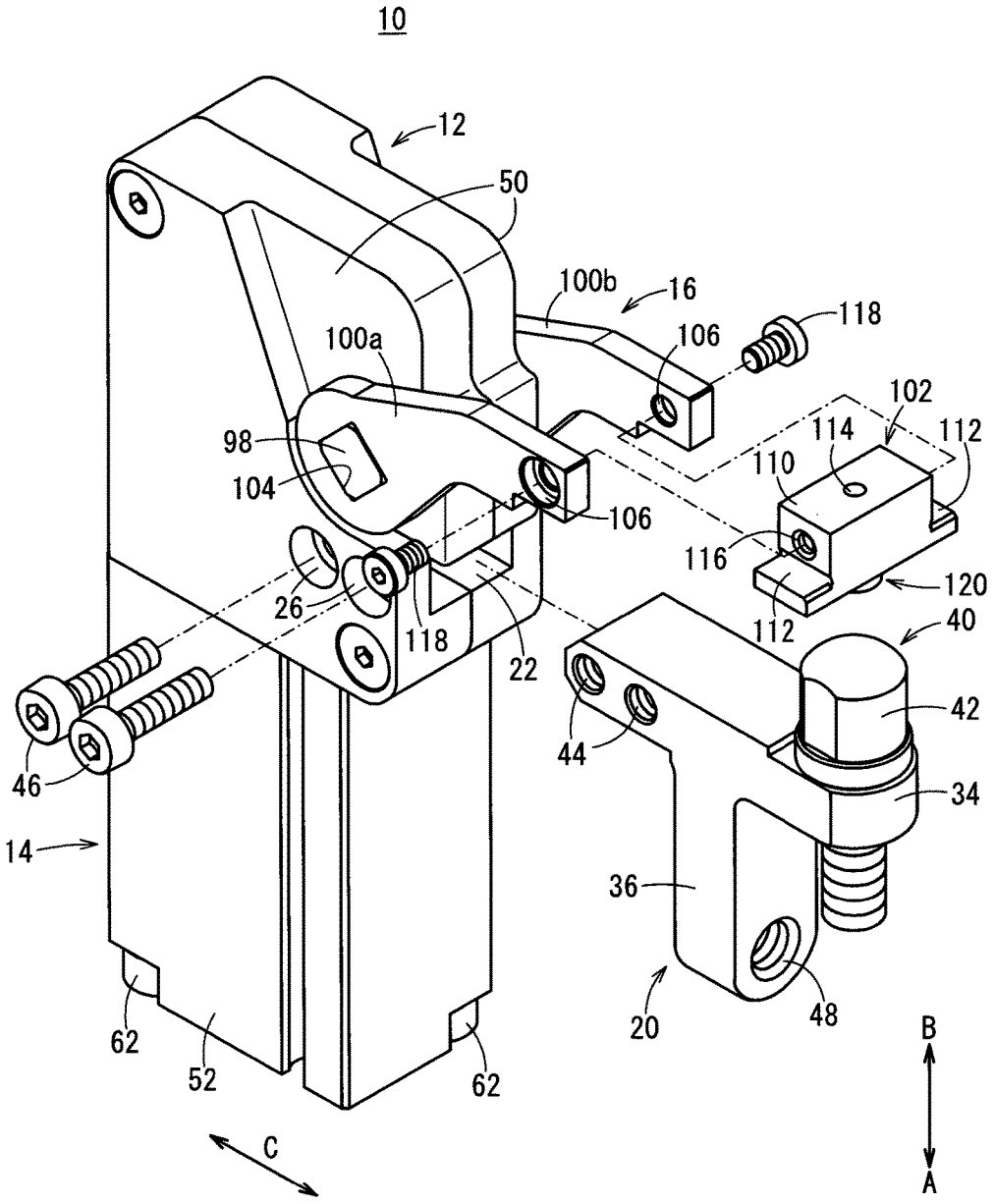
FIG. 3 is a partial exploded perspective view of the clamp apparatus of FIG. 1.

As shown in FIGS. 1 through 3, a clamp apparatus 10 includes a hollow body 12, a drive unit 14 provided on one end of the body 12, a clamp arm 16 disposed rotatably with respect to the body 12, and a driving force transmission mechanism 18 that transmits a driving force to the clamp arm 16 along an axial direction (the directions of arrows A and B) of the drive unit 14.

The body 12 is formed, for example, with an elongate rectangular shape in cross section, with one end of the body 12 being open, the drive unit 14 being connected to the body 12 so as to close the opening. A coupling hole 22 to which a support body 20 is connected opens on a side surface, which is perpendicular to the aforementioned opening. Additionally, a housing chamber 24 is formed in the interior of the body 12 in which the later-described driving force transmission mechanism 18 is accommodated. A pair of bolt holes 26 are formed in the body 12, in a side surface thereof substantially perpendicular to the direction in which the coupling hole 22 opens.

Figure 4A:
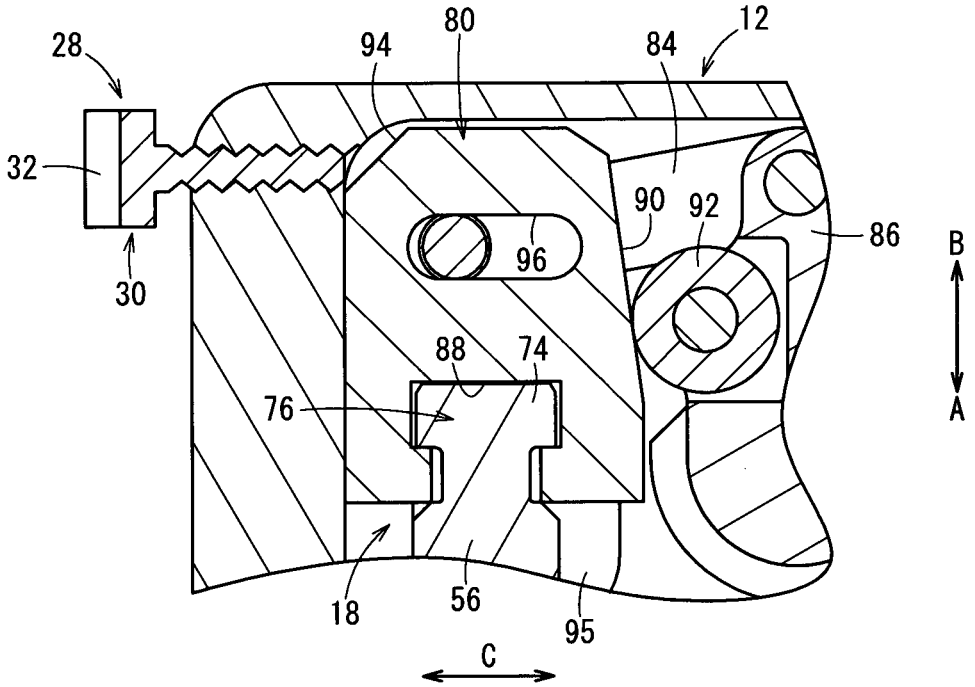
FIG. 4A is an enlarged cross-sectional view showing the vicinity of a clamp release mechanism in the clamp apparatus of FIG. 2.
Figure 4B:
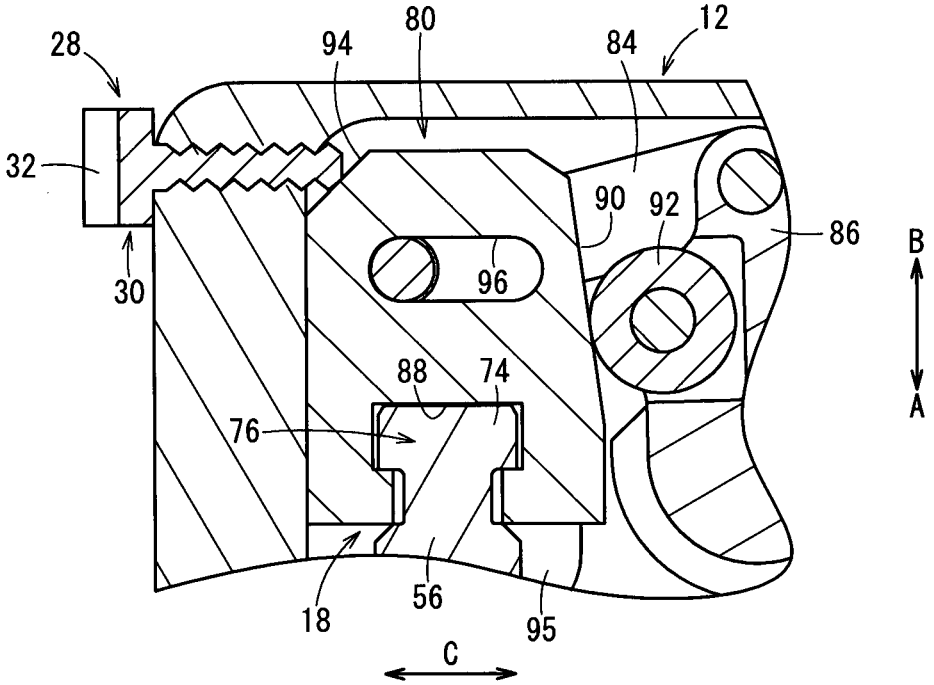
FIG. 4B is an enlarged cross-sectional view showing a condition in which the clamp release mechanism of FIG. 4A is operated and a clamped state is released.

Further, on the other side surface of the body 12, as shown in FIGS. 2, 4A and 4B, a clamp release mechanism 28 is provided for forcibly releasing the clamped state by the clamp arm 16. As shown in FIGS. 4A and 4B, the clamp release mechanism 28, for example, is constituted from a release screw (release member) 30, which is screw-engaged with respect to the other side surface of the body 12. The release screw 30 is disposed horizontally along the directions of the arrow C perpendicular to the longitudinal direction of the body 12, and the distal end thereof is inserted into the interior of the body 12.

Additionally, by gripping and rotating an operating member 32 that is arranged outside of the body 12, the release screw 30 is made to advance and retract along the axial direction (the directions of the arrow C), and the distal end thereof is brought into contact with a joint 80 of the later-described driving force transmission mechanism 18, to thereby press the joint 80 toward the side of the drive unit 14 (in the direction of the arrow A).

Furthermore, on the one surface side of the body 12, the support body 20, which is substantially T-shaped in cross section, is disposed detachably. The support body 20 is disposed so as to project laterally with respect to the one side surface of the body 12 and includes a support member 34, which projects horizontally (in the directions of the arrow C) with respect to the body 12, and an attachment member 36, which extends downward (in the direction of the arrow A) substantially perpendicular with respect to the support member 34.

The support member 34 is formed in a straight shape with a predetermined length, for example, and a first adjustment pin (gripper) 40 is screw-engaged through a first adjustment pin screw hole 38 that is formed in one end of the support member 34 (see FIG. 2). The first adjustment pin 40 is disposed in the first adjustment pin screw hole 38 so as to be capable of advancing and retracting in a direction perpendicular to the longitudinal direction of the support member 34. In addition, a substantially hemispherical shaped head 42 of the first adjustment pin 40 projects in an upward direction (the direction of the arrow B). Further, by rotating the first adjustment pin 40, the head 42 of the first adjustment pin 40 can be moved vertically (in the directions of arrows A and B).

On the other hand, on the other end of the support member 34, a pair of first fixing bolt holes 44 open respectively therein in a lateral direction (see FIG. 3). More specifically, the first fixing bolt holes 44 are formed substantially perpendicular to the first adjustment pin screw hole 38.

In addition, after the other end of the support member 34 has been inserted into the coupling hole 22 that opens laterally in the body 12, fixing bolts 46 are inserted through the bolt holes 26 of the body 12 and screw-engaged in the first fixing bolt holes 44, thereby fixing the support body 20 with respect to the body 12.

The attachment member 36, for example, is formed substantially centrally in the longitudinal direction (the direction of the arrow C) of the support member 34, and is formed so as to project downward (in the direction of the arrow A) a predetermined length with respect to the support member 34. On the end of the attachment member 36, an attachment bolt hole 48 is formed, which penetrates therethrough in a direction substantially parallel with the support member 34. The attachment bolt hole 48 is provided so that the clamp apparatus can be fixed onto another member when the clamp apparatus 10 is put to use on an assembly line or the like.

On the other hand, on both side surfaces of the body 12 perpendicular to the one side surface and the other side surface, recessed sections 50 are formed in which arm members 100*a*, 100*b* of the clamp arm 16 are accommodated respectively. The recessed sections 50 are sunken inwardly at a depth corresponding to the thickness of each of the arm members 100*a*, 100*b* with respect to opposite side surfaces of the body 12. Therefore, the arm members 100*a*, 100*b* of the clamp arm 16 are accommodated without projecting outside from the opposite side surfaces of the body 12.

As shown in FIG. 2, for example, the drive unit 14 includes a cylindrically shaped cylinder tube 52, a piston 54, which is disposed displaceably in the interior of the cylinder tube 52, a piston rod 56 connected to the piston 54, and a rod cover 58 that displaceably supports the piston rod 56.

The cylinder tube 52 includes a cylinder chamber 60 that penetrates centrally in the axial direction (the directions of arrows A and B), and an end of the cylinder tube 52 is disposed in abutment against an end surface of the body 12. In addition, fastening bolts 62, which are inserted through a pair of penetrating holes (not shown) that penetrate in the axial direction (the directions of arrows A and B) of the cylinder tube 52, are screw-engaged with respect to the body 12, whereby the drive unit 14 is connected with respect to the body 12.

Further, the other end of the cylinder tube 52 is closed by installation of a cap 64 in the interior of the cylinder chamber 60.

On the other hand, a first port 66, which is provided in one end side (in the direction of the arrow B), and a second port 68, which is provided in another end side (in the direction of the arrow A) and is separated a predetermined distance with respect to the first port 66, are formed in a side surface of the cylinder tube 52. The cylinder chamber 60 communicates with the exterior through the first and second ports 66, 68.

The first and second ports 66, 68 are connected through non-illustrated tubes to a pressure fluid supply source. Pressure fluid is supplied selectively to the first port 66 or the second port 68, and is introduced into the cylinder chamber 60, from the non-illustrated pressure fluid supply source.

The piston 54 is formed in the shape of a disk, for example, and a piston packing 70 is installed via an annular groove on the outer circumferential surface of the piston 54. Additionally, by abutment of the piston packing 70 against the inner wall surface of the cylinder chamber 60, leakage of pressure fluid between the piston 54 and the cylinder tube 52 is prevented.

One end of the piston rod 56 is connected integrally by caulking to a piston hole, which is formed in the center of the piston 54 in a state of being inserted through the piston hole. Further, a connector 76 having an annularly recessed neck part 72 and an expanded diameter part 74, which is expanded in diameter on a distal end with respect to the neck part 72, are formed on the other end of the piston rod 56. The neck part 72 and the expanded diameter part 74 are connected integrally through engagement with respect to the later-described joint 80 of the driving force transmission mechanism 18. Moreover, the neck part 72 and the expanded diameter part 74 are formed with circular shapes in cross section having different diameters, respectively.

The rod cover 58 is provided in an opening of the cylinder chamber 60 facing the body 12, thereby closing the opening, and a piston rod 56, which is inserted through the center of the rod cover 58, is supported displaceably along the axial direction (the directions of arrows A and B). A rod packing 78 is installed through an annular groove on an inner circumferential surface of the rod cover 58. The rod packing 78 slides in contact with the outer circumferential surface of the piston rod 56, whereby leakage of pressure fluid to the exterior from the cylinder chamber 60 is prevented.

Figure 5:
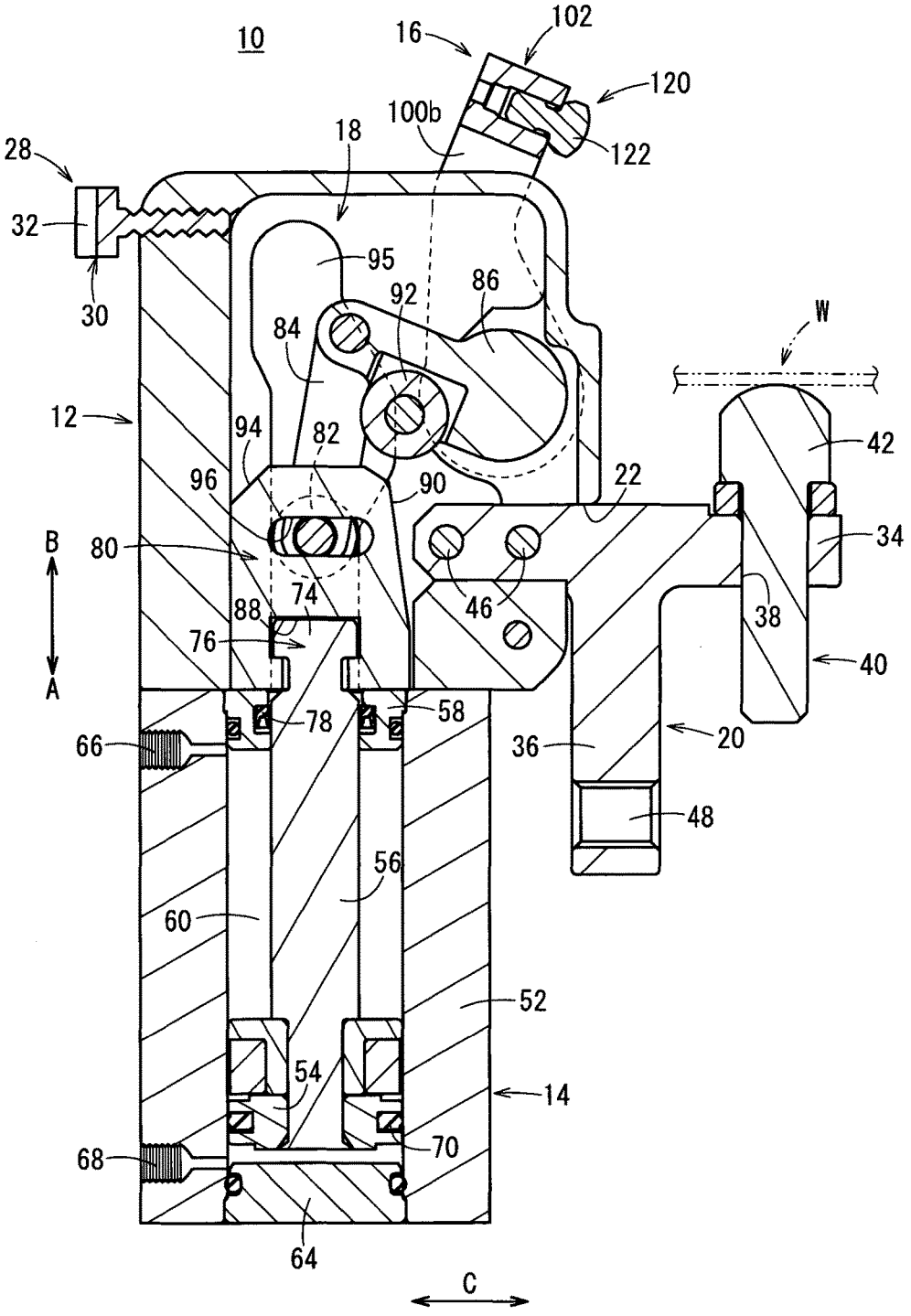
FIG. 5 is an overall cross-sectional view showing an unclamped state of the clamp apparatus of FIG. 2.

The driving force transmission mechanism 18, as shown in FIGS. 2 and 5, includes the joint 80, which is disposed in the housing chamber 24 of the body 12 and is connected to the other end of the piston rod 56, a pair of rollers 82 provided rotatably on an upper part of the joint 80, a link arm 84 supported pivotally on the joint 80 together with the rollers 82, and a lever arm 86 connected to the link arm 84 and the clamp arm 16.

The joint 80 is formed with a substantially rectangular shape in cross section, with a connecting recess 88, which is connected to the connector 76 of the piston rod 56, being formed on a lower end of the joint 80. The connecting recess 88 includes a small diameter part and a large diameter part, which are formed on an end surface side of the joint 80, so as to open on the end surface (in the direction of the arrow A) and on one side surface of the joint 80.

In addition, when the other end of the piston rod 56 is connected in the connecting recess 88 of the joint 80, the neck part 72 of the piston rod 56 engages with the small diameter part, whereas the expanded diameter part 74 of the piston rod 56 engages with the large diameter part.

On the other hand, as shown in FIG. 2, an inclined surface 90 that tapers gradually toward the upper end is formed on an upper portion of the joint 80 on a side surface facing toward the clamp arm 16. When the clamp arm 16 is rotated from an unclamped state (see FIG. 5) into a clamped state (see FIG. 2), a sub-roller 92, which is pivotally supported on the lever arm 86, abuts against the inclined surface 90.

Further, as shown in FIGS. 2, 4A and 4B, on an upper side of the joint 80, a chamfered portion 94 is formed, which is inclined at a predetermined angle to the angle of the side surface on an opposite side from the inclined surface 90. At a time when the clamp arm 16 clamps with the joint 80 being elevated to a highest location, the chamfered portion 94 is disposed at a position that faces toward the release screw 30 of the clamp release mechanism 28. The chamfered portion 94, similar to the inclined surface 90, is tapered gradually in an upward direction.

In addition, as shown in FIG. 4B, by movement of the release screw 30 toward the side of the joint 80, the distal end thereof contacts the chamfered portion 94, and the joint 80 is pressed downward (in the direction of the arrow A).

The rollers 82 are inserted into roller grooves 95 that are formed along the axial direction of the body 12, such that upon movement thereof, the joint 80 is guided in the vertical direction (the directions of arrows A and B) and rotational displacement of the joint 80 is restricted.

Further, the rollers 82 are movable over a predetermined distance in a direction (the directions of the arrow C) perpendicular to the axial direction of the joint 80 through a link groove 96, which is formed in the upper part of the joint 80. An end of the link arm 84, which is pivotally supported together with the rollers 82 on the joint 80, also is movable in a direction (the directions of the arrow C) perpendicular to the axial direction of the joint 80.

The link arm 84 is connected between the lever arm 86 and an upper part of the joint 80. The link arm 84 is pivotally supported together with the rollers 82 with respect to the joint 80, and is supported mutually and rotatably with respect to the lever arm 86 through a link pin. In addition, the link arm 84 converts linear motion of the piston rod 56 into rotational motion of the clamp arm 16 via the joint 80.

The lever arm 86 is connected to ends of the link arm 84 and the clamp arm 16, and the sub-roller 92 is axially supported rotatably in the middle of the lever arm 86. Additionally, the clamp arm 16 is connected to the lever arm 86 through support pins 98 (see FIG. 1), which are rectangular in cross section and are formed at connected regions thereof with the clamp arm 16, such that upon rotation of the lever arm 86, the sub-roller 92 rotates in abutment against the inclined surface 90 of the joint 80.

As shown in FIGS. 1 through 3, for example, the clamp arm 16 is substantially U-shaped in cross section and is disposed externally of the body 12, having a pair of arm members 100*a*, 100*b*, which are connected to the support pins 98 that project from both side surfaces of the body 12, and a connecting body 102, which is connected to other ends of the arm members 100*a*, 100*b*.

Support holes 104, into which the cross-sectional rectangular support pins 98 are inserted, are formed in one end, and insertion holes 106, which penetrate in the thicknesswise direction, are formed in the other end of the arm members 100*a*, 100*b*. Together therewith, stepped parts 108 are formed on the arm members 100*a*, 100*b*, which are separated a predetermined distance with respect to the insertion holes 106. The stepped parts 108, which are formed on the side of the support body 20 (in the direction of the arrow A) at the time that the clamp arm 16 is clamped, are formed along directions in which the arm members 100*a*, 100*b* extend, and are formed with rectangular shapes in cross section cutout from ends of the arm members 100*a*, 100*b* in the widthwise direction thereof.

In addition, the one arm member 100*a* and the other arm member 100*b* are separated a predetermined distance sandwiching the body 12 therebetween, and are connected mutually by the connecting body 102, thereby forming a U-shape in cross section.

The connecting body 102, for example, is made up from a block body having a rectangular shape in cross section, which is disposed between the one arm member 100*a* and the other arm member 100*b*. The connecting body 102 includes a main body portion 110, and flanges 112 that project outward respectively in a lateral direction with respect to the main body portion 110. Additionally, a second adjustment pin screw hole 114 is formed in the main body portion 110 in a direction perpendicular to the widthwise direction thereof, and second fixing bolt holes 116 are formed respectively in opposite side surfaces that face toward the arm members 100*a*, 100*b*.

The main body portion 110 is arranged between the one arm member 100*a* and the other arm member 100*b*, such that both side surfaces of the main body portion 110 are placed in abutment, respectively, with the arm members 100*a*, 100*b*, and the flanges 112 are inserted respectively into the stepped parts 108. In this state, fixing bolts 118, which are inserted through the insertion holes 106 of the arm members 100*a*, 100*b*, are screw-engaged respectively with the second fixing bolt holes 116. As a result, the connecting body 102 is connected integrally between the pair of arm members 100*a*, 100*b*.

Stated otherwise, by loosening and unscrewing the fixing bolts 118, the connecting body 102 can freely be detached from the arm members 100*a*, 100*b*.

Further, a second adjustment pin (gripper) 120 is screw-engaged in the second adjustment pin screw hole 114 of the main body portion 110. The second adjustment pin 120 has a head 122 having a roughly hemispherical shape and projects with respect to the other end of the arm members 100*a*, 100*b*, and is screw-engaged therein so that the projecting height thereof with respect to the other end can be changed by rotation of the second adjustment pin 120. Further, when the workpiece W is clamped, as shown in FIG. 2, the second adjustment pin 120 is disposed so as to face the first adjustment pin 40 on the support body 20. Thus, in a clamped state in which the clamp arm 16 is rotated through a predetermined angle, the workpiece W is clamped and gripped between the first adjustment pin 40 and the second adjustment pin 120.

Figure 6:
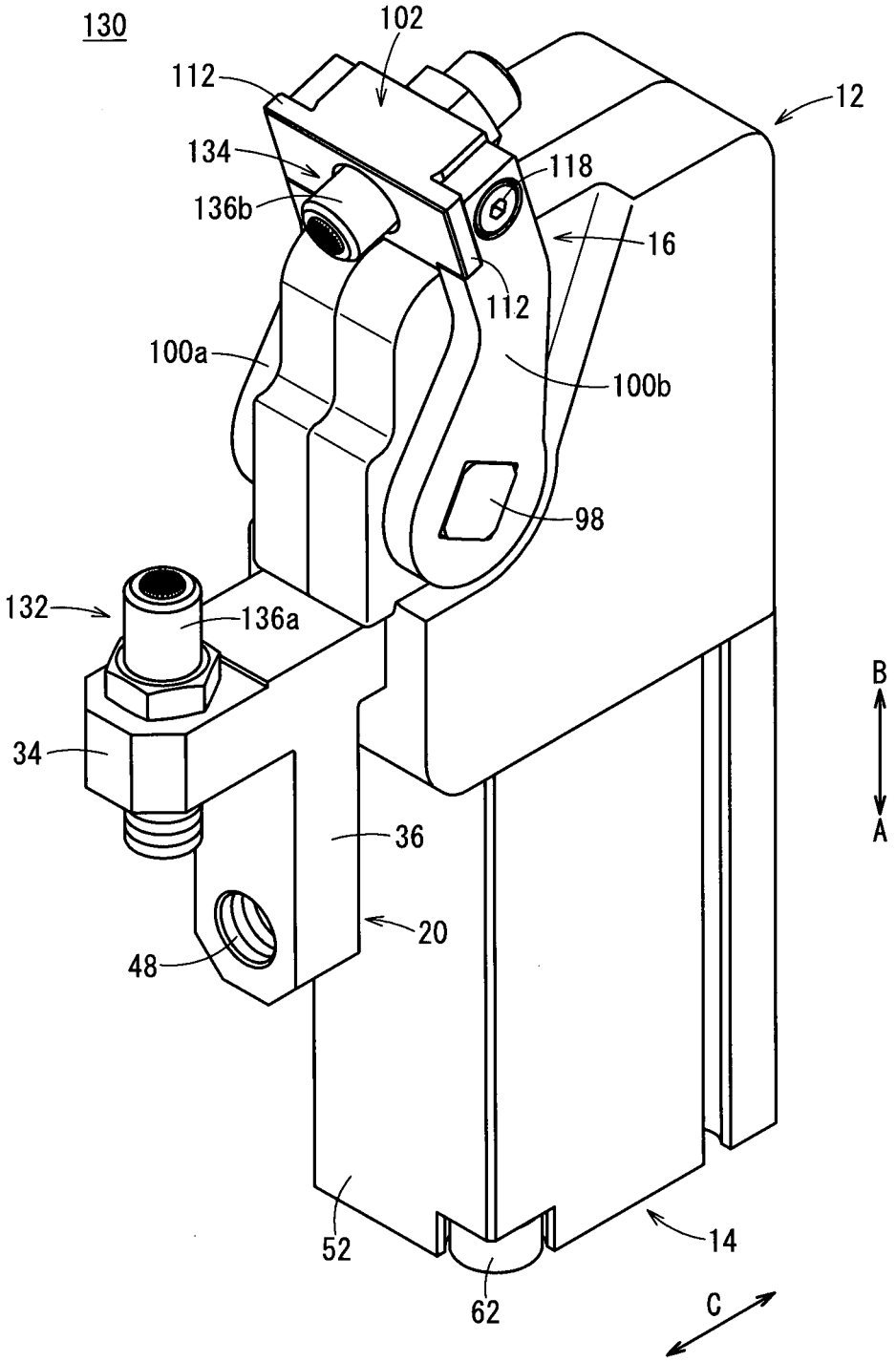
FIG. 6 is an exterior perspective view showing a clamp apparatus according to a modification in which first and second adjustment pins having substantially planar ends are installed thereon as an attachment.

According to the above description, the heads 42, 122 of the first and second adjustment pins 40, 120 are roughly hemispherical in shape. However, the present invention is not limited to this feature. For example, as in the clamp apparatus 130 shown in FIG. 6, heads 136*a*, 136*b* of the first and second adjustment pins 132, 134 may be formed with planar shapes, which are perpendicular to the axial lines thereof, such that when the workpiece W is clamped between the first adjustment pin 132 and the second adjustment pin 134, the first and second adjustment pins 132, 134 can clamp the workpiece W while being in surface contact with respect to the workpiece W.

Owing thereto, it is possible to clamp the workpiece W with better accuracy and stability. Further, corresponding to the workpiece W, the distal ends of the heads 136*a*, 136*b* may utilize attachments, which are recessed with V-shapes in cross section.

More specifically, without requiring the clamp arm 16 to be changed each time responsive to the shape of the workpiece W, but rather, by exchanging the first adjustment pin 132 and the second adjustment pin 134 responsive to the shape, clamping can easily be performed irrespective of the shape of the workpiece W.

Further, with the above-described clamp release mechanism 28, a case has been described in which the release screw 30 is advanceable and retractable along the axial direction by a screwing action thereof. However, as in a clamp release mechanism 150 shown in FIG. 7A, a structure may be provided made up from a release pin (release member) 152 that is disposed movably in a horizontal direction (the directions of the arrow C) with respect to the body 12, and a spring 154 that biases the release pin 152 in the horizontal direction.

The release pin 152 that constitutes the clamp release mechanism 150, similar to the release screw 30, is disposed movably with respect to the other side surface of the body 12, and a pressing member 156 that presses the chamfered portion 94 of the joint 80 is formed on the distal end thereof and is inserted into the interior of the body 12. The distal end of the pressing member 156, for example, is formed in a substantially hemispherical shape.

On the other hand, a flange 158 that is expanded radially outward in diameter is formed on the other end of the release pin 152. The flange 158 is positioned externally of the body 12, and the aforementioned spring 154 is disposed between the flange 158 and the body 12. The spring 154, for example, is a coil spring formed in a helical shape, which biases the flange 158 in a direction away from the body 12.

Figure 7A:
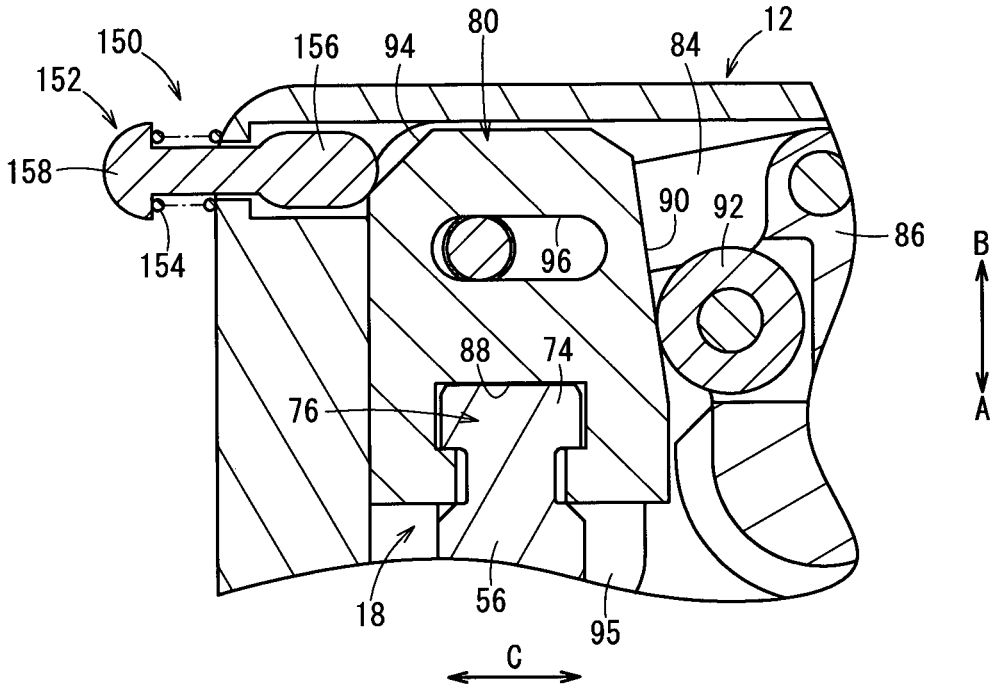
FIG. 7A is an enlarged cross-sectional view showing the vicinity of a clamp release mechanism according to a modification.
Figure 7B:
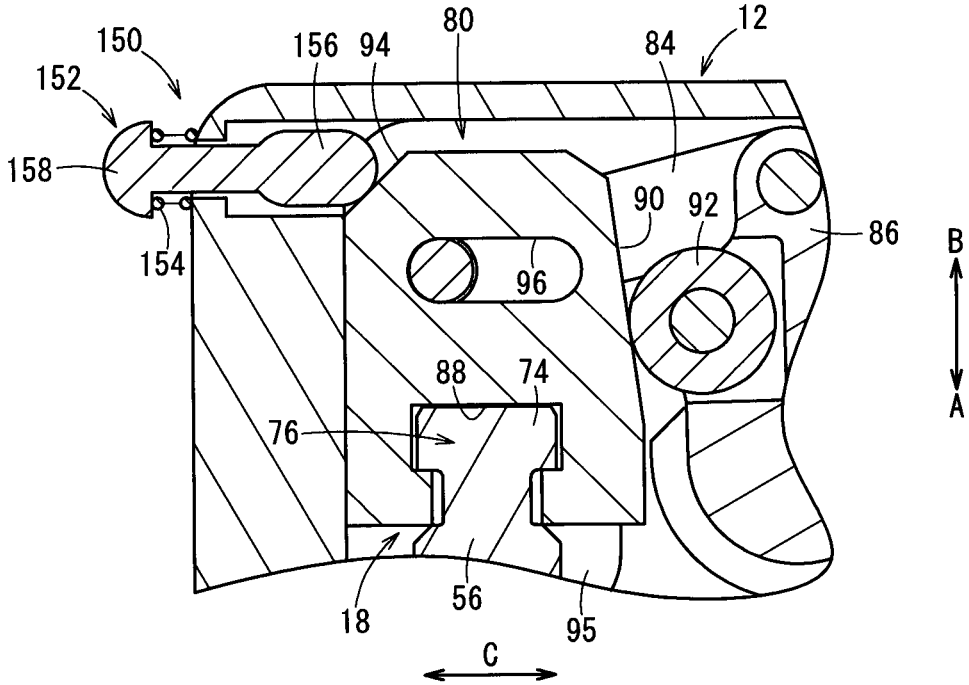
FIG. 7B is an enlarged cross-sectional view showing a condition in which the clamp release mechanism of FIG. 7A is operated and a clamped state is released.

In addition, by a non-illustrated operator pressing the other end of the release pin 152 toward the side of the body 12 in opposition to the elastic force of the spring 154, as shown in FIG. 7B, the pressing member 156 of the release pin 152 is moved toward the side of the joint 80, and by coming into contact with and pressing the chamfered portion 94 of the joint 80, the joint 80 is pressed toward the side of the drive unit 14 (in the direction of the arrow A).

Further, when the pressing action with respect to the release pin 152 is released, by the elastic force of the spring 154, the release pin 152 is moved again in a direction away from the joint 80 and is restored to the state shown in FIG. 7A.

In this manner, with the clamp release mechanism 150 shown in FIGS. 7A and 7B, since by releasing the pressing force with respect to the release pin 152, the release pin 152 is easily restored to the initial position, after the clamped condition of the workpiece W has been released, there is no need for the operator to restore the release pin 152 to its initial position, and maintenance of the clamp-released state by mistake can be avoided.

Figure 8A:
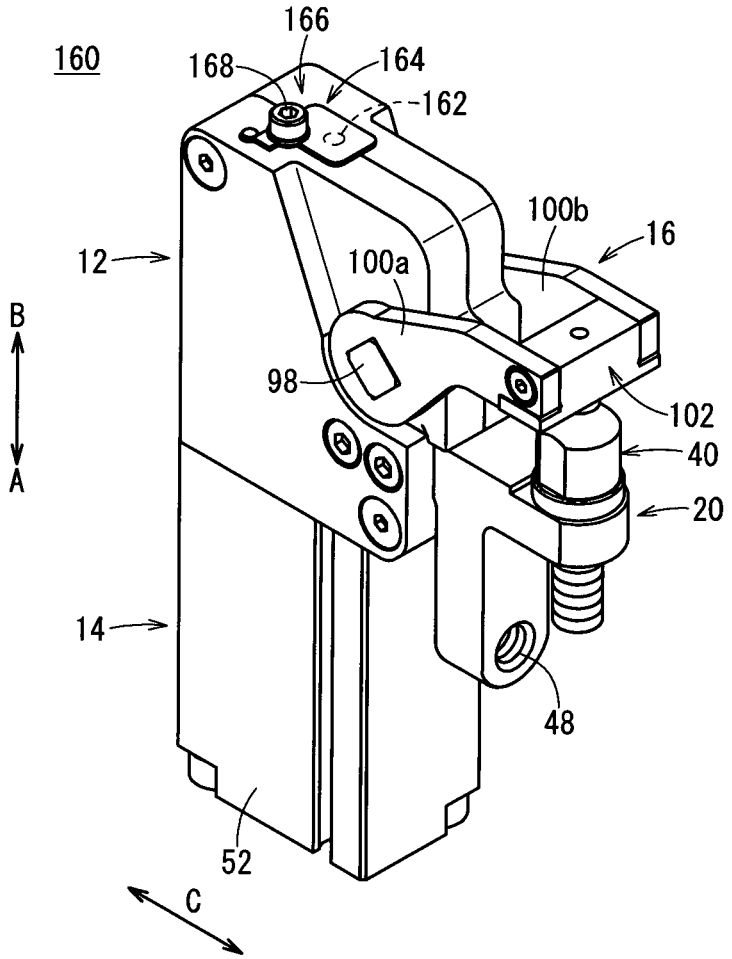
FIG. 8A is an exterior perspective view showing the vicinity of a clamp release mechanism according to a modification.
Figure 8B:
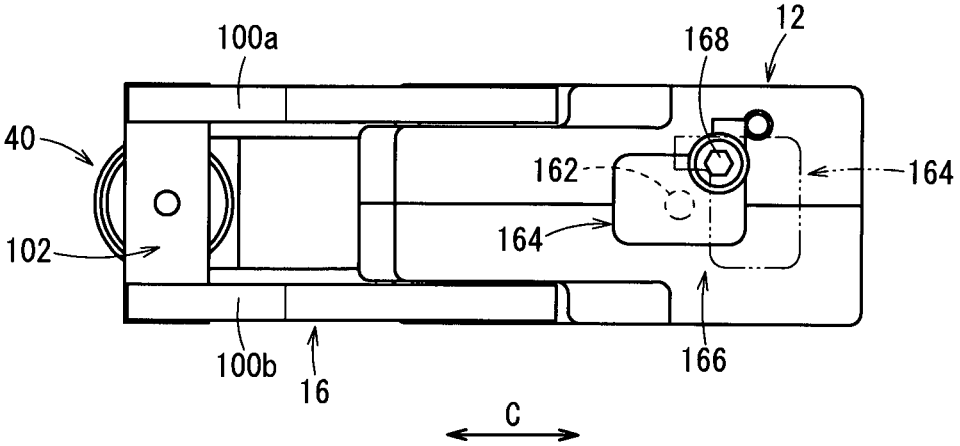
FIG. 8B is a plan view showing the clamp apparatus including the clamp release mechanism of FIG. 8A.

Furthermore, the clamp release mechanisms 28, 150 are not limited to the case of being disposed on the other side surface of the body 12, as has been described above. Alternatively, for example, as in a clamp apparatus 160 shown in FIGS. 8A and 8B, a clamp release mechanism 166 may be provided, which includes a hole 162 that penetrates to the interior on an upper portion of the body 12, and an opening/closing lid 164 that is capable of closing the hole 162.

With the clamp release mechanism 166, the hole 162 is formed to penetrate through the body 12 in facing relation to the upper surface of the joint 80. By a non-illustrated operator using a tool such as a jig or the like through the hole 162, the joint 80 can be pressed downward (in the direction of the arrow A).

Further, the opening/closing lid 164 is formed with a substantially rectangular shape, with one corner thereof being supported by a lid fixing bolt 168 with respect to the upper surface of the body 12, such that the opening/closing lid 164 is rotatable about the lid fixing bolt 168. In addition, in the case that the clamp release mechanism 166 is not being used, by closing the hole 162 with the opening/closing lid 164, entry of dust or spatter or the like through the hole 162 and into the interior of the body 12 can be prevented, whereas by moving the opening/closing lid 164 to expose the hole 162 (as shown by the two-dot-dashed line in FIG. 8B), release of the clamped condition can be performed through the hole 162.

The clamp apparatus 10 according to the embodiment of the present invention is constructed basically as described above. Next, operations and advantages of the clamp apparatus 10 will be described. In the following descriptions, the unclamped state shown in FIG. 5 will be treated as an initial position.

In the initial condition, pressure fluid is supplied to the first port 66, and by lowering of the piston 54, via the driving force transmission mechanism 18, the clamp arm 16 is placed in a state of being separated substantially perpendicular with respect to the support body 20. Further, a thin plate-shaped workpiece W is mounted beforehand with respect to the support body 20 of the body 12.

At first, in the initial position of the clamp apparatus 10 shown in FIG. 5, under a switching operation of a non-illustrated switching device, the pressure fluid which had been supplied to the first port 66 is supplied instead to the second port 68 from the pressure fluid supply source, while the first port 66 is placed in a state of being open to atmosphere. Consequently, by action of the pressure fluid, which is introduced from the second port 68 into the cylinder chamber 60, the piston 54 is pressed upwardly toward the side of the body 12 (in the direction of the arrow B), and the piston rod 56 is displaced integrally with the piston 54.

In addition, accompanying displacement of the piston rod 56 and under a guiding action of the rollers 82 with respect to the roller grooves 95, the joint 80 is moved in an upward direction (in the direction of the arrow B), whereupon the link arm 84 starts to rotate clockwise about a location where the link arm 84 is pivotally supported on the joint 80. Together with rotation of the link arm 84, the lever arm 86 rotates, and by rotation of the lever arm 86, the clamp arm 16 is rotated through a predetermined angle clockwise about the support pins 98.

Consequently, as shown in FIG. 2, the second adjustment pin 120 of the clamp arm 16 abuts against the workpiece W, and a clamped state is brought about in which the workpiece W is gripped between the second adjustment pin 120 and the first adjustment pin 40 provided on the body 12.

At this time, accompanying rotation of the clamp arm 16, the rollers 82 are moved via the link arm 84 along the roller grooves 95 in a direction to approach the clamp arm 16, and together therewith, the sub-roller 92 abuts against the inclined surface 90 of the joint 80, whereby the clamp arm 16 is pressed, and a locked state is brought about in which further rotation of the clamp arm 16 is locked. As a result, the clamped state of the workpiece W by the clamp arm 16 is maintained.

On the other hand, in the event that the clamped state of the workpiece W shown in FIG. 2 is released, under a switching operation of the non-illustrated switching device, the pressure fluid which had been supplied to the second port 68 is supplied instead to the first port 66, while the second port 68 is placed in a state of being open to atmosphere. By action of the pressure fluid, which is supplied to the first port 66 and introduced into the cylinder chamber 60, the piston 54 is pressed downward in a direction to separate from the body 12 (in the direction of the arrow A), and the piston rod 56 is lowered integrally with the piston 54.

In addition, accompanying displacement of the piston rod 56, the joint 80 is moved in a downward direction under a guiding action of the rollers 82 with respect to the roller grooves 95, and along therewith, the link arm 84 is rotated counterclockwise about a location where the link arm 84 is pivotally supported on the joint 80. Together with rotation of the link arm 84, the lever arm 86 rotates, and by rotation of the lever arm 86, the clamp arm 16 is rotated through a predetermined angle counterclockwise about the support pins 98. Consequently, the clamp arm 16 separates away from the support body 20, and the clamped state of the workpiece W is released.

Next, in the clamped state of the workpiece W, a case will be described in which supply of pressure fluid to the drive unit 14 is stopped, and the workpiece W remains in the clamped state, as shown in FIG. 2. In this case, a non-illustrated operator grips the operating member 32 of the release screw 30 on the clamp release mechanism 28 shown in FIG. 4A, and rotates the release screw 30 in a predetermined direction. Consequently, as shown in FIG. 4B, the distal end of the release screw 30 moves toward the side of the joint 80, and the distal end thereof comes into contact with the chamfered portion 94 of the joint 80, whereby the joint 80 is pressed downward (in the direction of the arrow A) toward the side of the drive unit 14.

More specifically, in the clamp release mechanism 28, due to contact with the chamfered portion 94, which is inclined with respect to the horizontal direction, the horizontally directed motive force of the release screw 30 is converted into a vertically downward directed pressing force, thereby pressing the joint 80 downward.

Consequently, accompanying lowering of the joint 80, the link arm 84 rotates counterclockwise about a location where the link arm 84 is pivotally supported on the joint 80, and via the lever arm 86, the clamp arm 16 is rotated through a predetermined angle counterclockwise about the support pins 98. Therefore, the clamp arm 16 opens in a direction to separate away from the support body 20, and the clamped state of the workpiece W is released.

As a result, the pressing force from the inclined surface 90 of the joint 80 to the sub-roller 92 is relaxed, and a state is brought about in which the clamp arm 16 can be rotated manually by a non-illustrated operator, thereby allowing the workpiece W to be removed.

More specifically, even if the driving force of the drive unit 14 is stopped and the clamped state of the workpiece W becomes locked, by operating the clamp release mechanism 28, since the joint 80 can be pressed down to release the pressing force applied to the sub-roller 92, the rotation-locked state of the clamp arm 16 through the sub-roller 92 can be released reliably and easily.

Next, a case will be described in which, corresponding to the shape of the workpiece W to be clamped, the support body 20 and the clamp arm 16 in the clamp apparatus 10 are exchanged. In this regard, a case will be described in which another workpiece is clamped, which is larger than the workpiece W clamped by the above-described clamp apparatus 10.

At first, as shown in FIG. 3, the couple of fixing bolts 118 are unscrewed and taken out with respect to the other end of the clamp arm 16, and the connecting body 102, having been released from its connected state, is removed from the arm members 100*a*, 100*b*.

In addition, after the couple of fixing bolts 46, which are fastened in the body 12, have been unscrewed and taken out from the bolt holes 26, the support body 20 is pulled outside and removed from the coupling hole 22. Consequently, a state is brought about in which both the support body 20 and the connecting body 102 are removed from the clamp apparatus 10. Note that in the foregoing explanation, although a case has been described in which the support body 20 is removed after removal of the connecting body 102, the order of removal is not particularly limited, and the support body 20 may be removed first.

Figure 9:
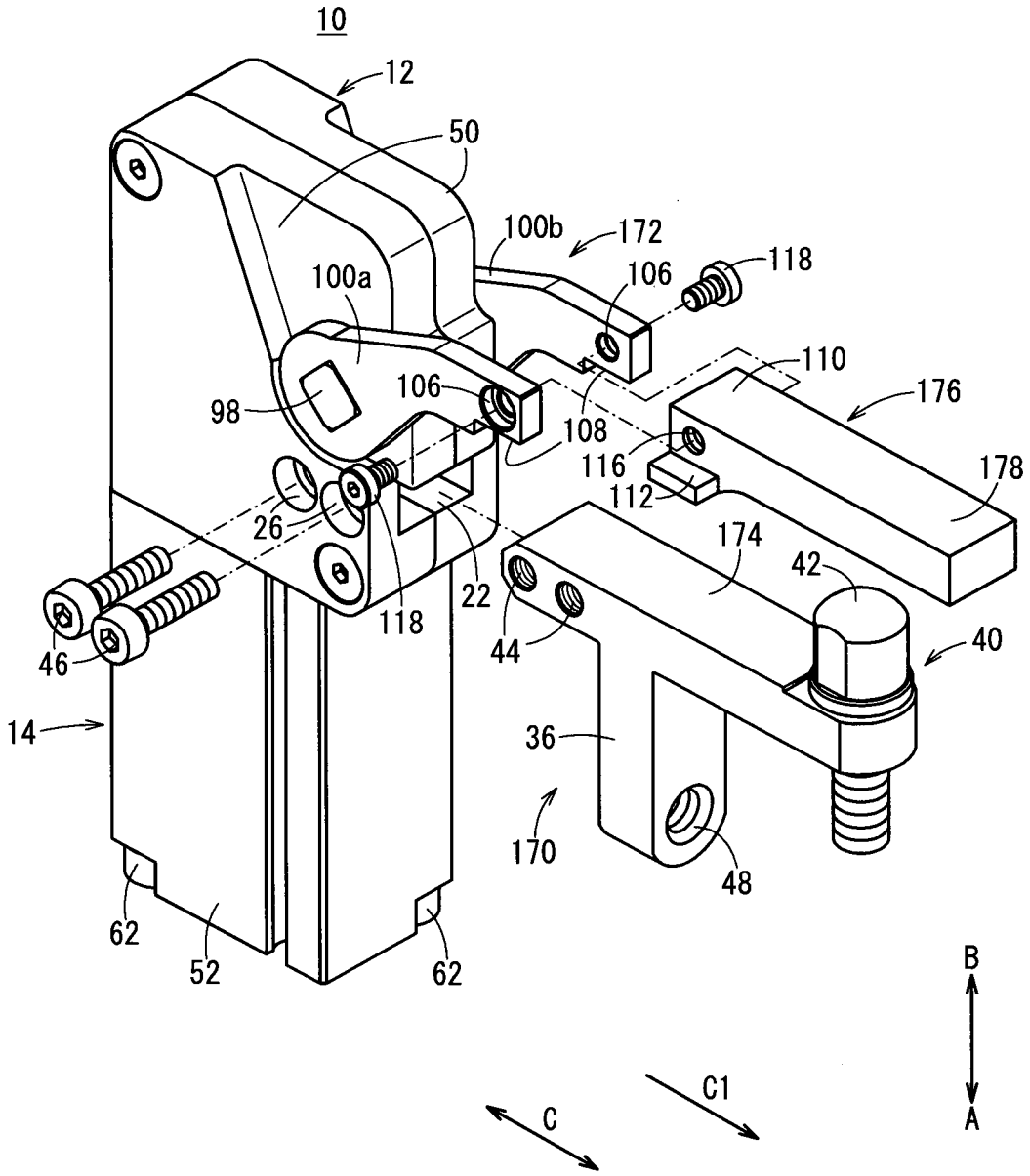
FIG. 9 is a partially exploded perspective view of a clamp apparatus having a newly-provided different clamp arm and support body.
Figure 10:
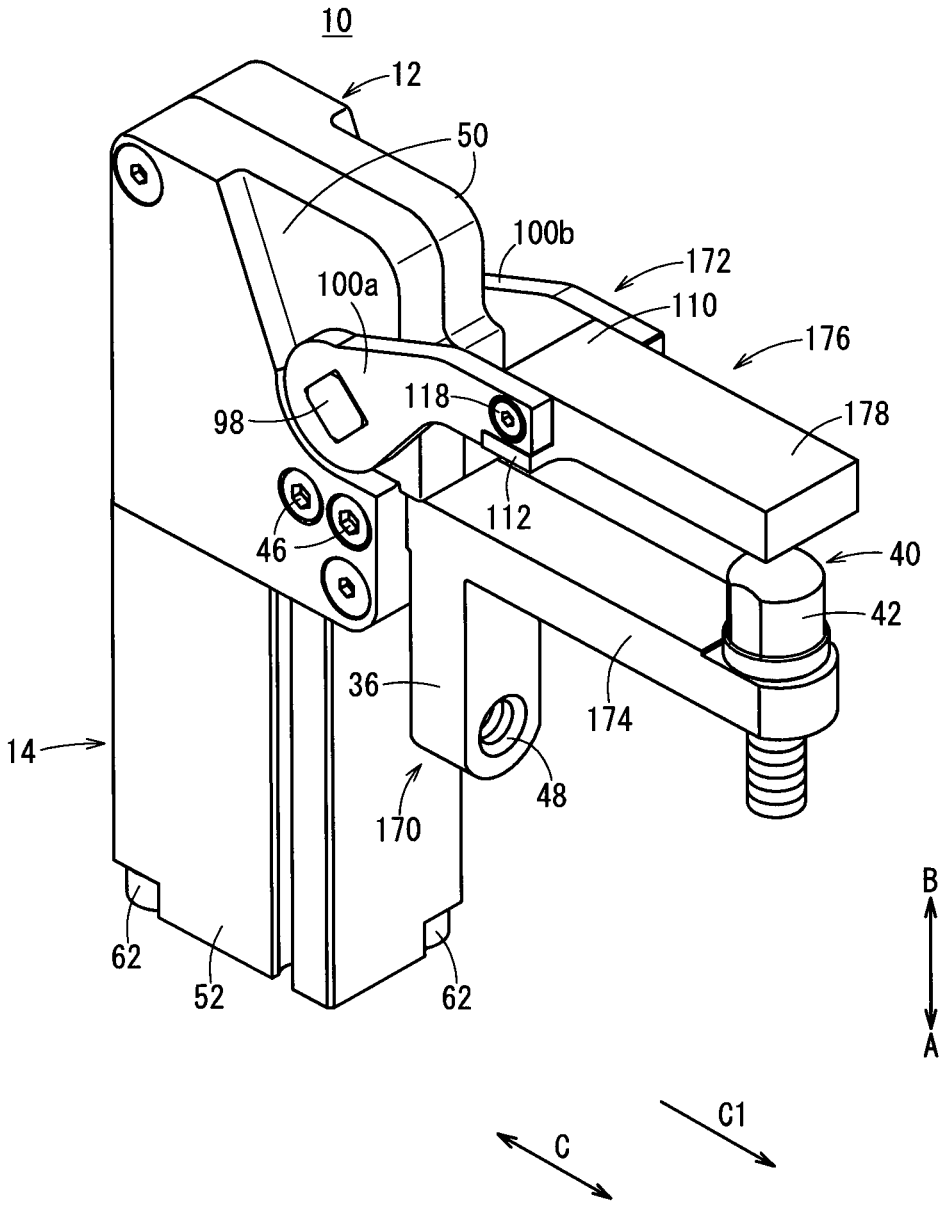
FIG. 10 is an exterior perspective view showing the clamp apparatus of FIG. 9 in an assembled condition.

Next, a brief description shall be made with reference to FIGS. 9 and 10 concerning a support body 170 and a clamp arm 172, which are newly attached on the above-described clamp apparatus 10. The support body 170 includes a support member 174, which is of a longer dimension than the aforementioned support body 20, and the one end side of the support member 174 (in the direction of the arrow C1) is formed to be longer with respect to the attachment member 36. The other end side of the support body 170 and the attachment member 36 are formed in substantially the same shape as the aforementioned support body 20. In addition, in the one end of the support member 174, a first adjustment pin 40 is screw-engaged therein via a first screw adjustment pin screw hole.

A main body portion 110 and flanges 112 of a connecting body 176 are formed roughly in the same shapes as with the connecting body 102, and the connecting body 176 further includes a projecting portion 178 that projects a predetermined length with respect to the main body portion 110. The projecting portion 178 extends in a straight line with respect to the main body portion 110, and the second adjustment pin (not shown) is screw-engaged via a second adjustment pin screw hole in the distal end of the projecting portion 178.

Next, in the event that a new support body 170 and a new connecting body 176 are to be assembled on the clamp apparatus 10, then as shown in FIG. 9, the main body portion 110 of the connecting body 176 is inserted between the arm members 100*a*, 100*b*, and the flanges 112 thereof are placed in engagement with the stepped parts 108. Further, in this condition, after a pair of bolts has been inserted through the insertion holes 106 of the arm members 100*a*, 100*b*, the bolts are screw-engaged respectively with the second fixing bolt holes 116 of the main body portion 110. As a result, the main body portion 110 of the new connecting body 176 is connected between ends of the arm members 100*a*, 100*b*.

Next, the other end of the support body 170 is inserted into the coupling hole 22 of the body 12, and by inserting the fixing bolts 46 through the bolt holes 26, and screwing and fastening the fixing bolts 46 in the first fixing bolt holes 44, the one end side of the support body 170 is fixed so as to project on the outer side of the body 12 (see FIG. 10).

Consequently, as shown in FIG. 10, in the clamp apparatus 10, the horizontally elongate support body 170 and the connecting body 176 are exchanged, and by rotating the clamp arm 172, a larger sized workpiece can be gripped by the first and second adjustment pins 40, 120, which are arranged at positions separated from the body 12.

In this manner, using a single clamp apparatus 10, since workpieces W of different shapes can easily be clamped simply by exchanging the support body 20 and the connecting body 102, compared to the case of preparing different clamp apparatus respectively corresponding to the workpieces W, investments in equipment can be suppressed and equipment costs can be reduced.

As described above, according to the present embodiment, in the clamp apparatus 10, the support body 20 is disposed detachably with respect to the body 12, and together therewith, the clamp arm 16 also is disposed detachably with respect to the connecting body 102. Accordingly, the support body 20 and the connecting body 102 can be exchanged appropriately to match with the size or shape of the workpiece W. Thus, with a single clamp apparatus 10, workpieces W of various sizes can be handled and clamped appropriately. As a result, compared to the case of preparing different clamp apparatus respectively corresponding to the workpieces W, investments in equipment can be suppressed.

Further, in the body 12, in a clamped state of the workpiece W by the clamp arm 16, even if due to some reason the driving force from the drive unit 14 is stopped, by a non-illustrated worker operating the clamp release mechanism 28, the clamped state can forcibly be released manually, and thus, the clamped state of the workpiece W can be released to allow the workpiece W to be removed.

Figure 11:
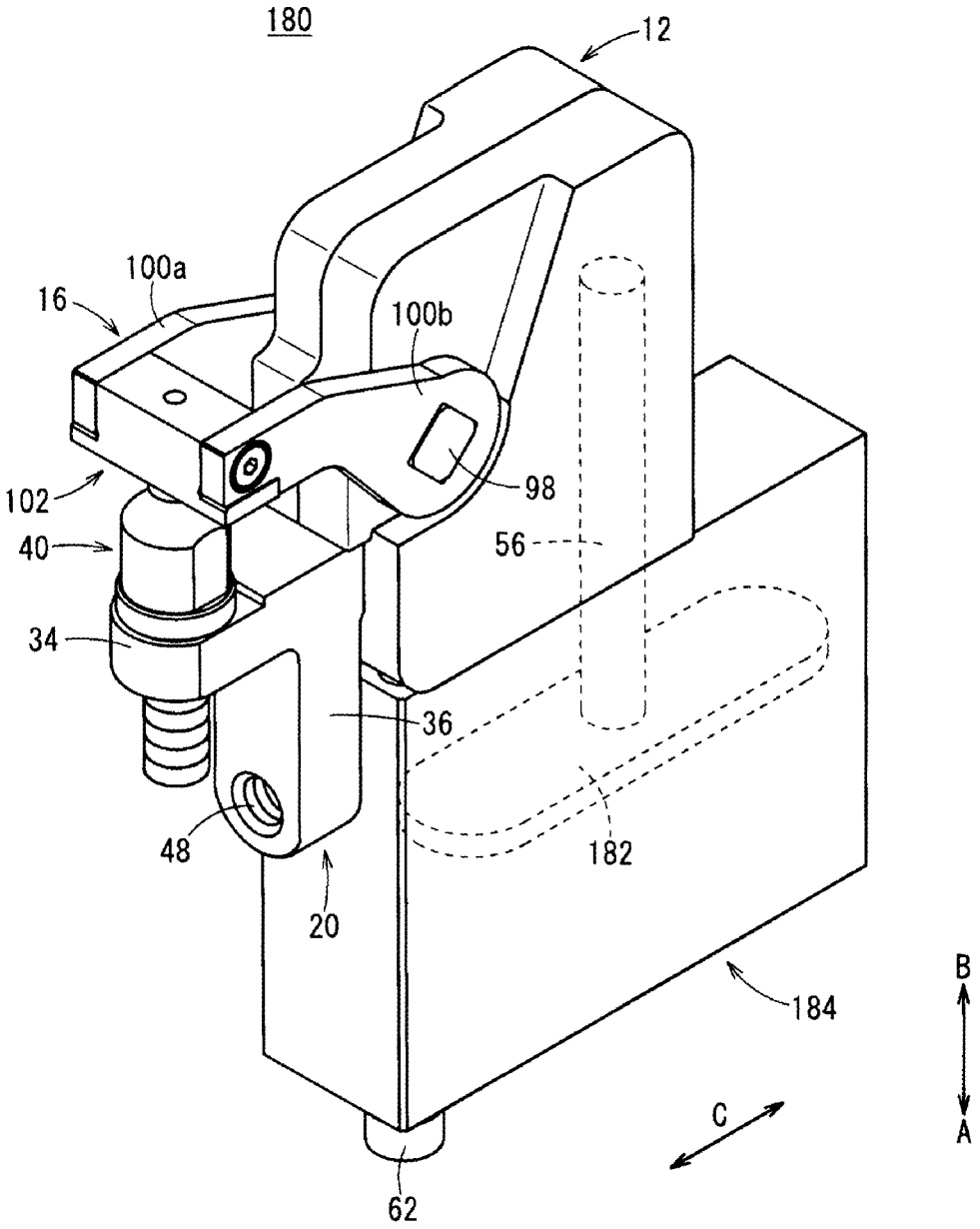
FIG. 11 is an exterior perspective view of a clamp apparatus to which a drive unit having a flat-shaped piston is applied.

Furthermore, by adopting a drive unit 184 having a piston 182 that is elliptically shaped in cross section, as in a clamp apparatus 180 shown in FIG. 11, the pressure-receiving area (piston area) of the piston 182 can be increased, while additionally, there is no increase in the longitudinal dimension in the vertical direction (the directions of arrows A and B) of the clamp apparatus 180. Therefore, without increasing the longitudinal dimension of the clamp apparatus 180, a higher output from the drive unit 184 can be realized.

The clamp apparatus according to the present invention is not limited to the above embodiments. Various changes and modifications may be made to the embodiments without departing from the scope of the invention as set forth in the appended claims.

The invention claimed is:

1. A clamp apparatus for clamping a workpiece by rotation of a clamp arm, comprising:

a body;

a drive unit including a piston that is displaced along an axial direction upon supply of a pressure fluid;

a driving force transmission mechanism disposed in an interior of the body and including a joint to which the drive unit is connected, the driving force transmission mechanism converting linear displacement of the drive unit along the axial direction into rotational displacement, and transmitting a driving force of the drive unit to the clamp arm;

a support body disposed detachably with respect to the body, the workpiece being gripped between the clamp arm and the support body; and a clamp release mechanism, which is configured to release a clamped state by the clamp arm at a time that the workpiece is clamped, wherein the clamp release mechanism includes a release member that is disposed so as to be movable toward a side of the joint, and is configured to press the joint in the axial direction, wherein the side of the joint includes a chamfered portion, and the release member is disposed so as to be movable toward the side of the joint, and into contact with the chamfered portion, by moving in a direction perpendicular to the axial direction, and wherein the clamp arm includes a pair of arm members supported rotatably with respect to the body, and a connecting body, which interconnects end portions of the arm members, the connecting body being disposed detachably with respect to the arm members.

2. The clamp apparatus according to claim 1, wherein the release member is disposed so as to be configured to approach toward and separate away from the joint by screw-engagement and being rotated with respect to the body.

3. The clamp apparatus according to claim 1, wherein a pair of grippers for gripping the workpiece are disposed on the support body and the clamp arm, respectively, the pair of grippers being disposed detachably with respect to the support body and the clamp arm.

4. The clamp apparatus according to claim 3, wherein at least one of the grippers is screw-engaged so as to be configured to advance and retract toward and away from the workpiece.

5. The clamp apparatus according to claim 1, wherein the drive unit comprises a fluid pressure cylinder in which the piston is formed with an elliptical shape or an oblong oval shape in cross section, and a cylinder body in which the piston is accommodated is formed with a rectangular shape in cross section.

* * * * *